US005115636A

United States Patent [19]

Zeiser

[11] Patent Number: 5,115,636

[45] Date of Patent: May 26, 1992

[54] BORESCOPE PLUG

[75] Inventor: Philip R. Zeiser, Cincinnati, Ohio

[73] Assignee: General Electric Company, Cincinnati, Ohio

[21] Appl. No.: 581,606

[22] Filed: Sep. 12, 1990

[51] Int. Cl.[5] ..... F02G 1/00

[52] U.S. Cl. ..... 60/39.33; 415/118

[58] Field of Search ..... 60/39.33, 39.32, 705; 415/118; 356/241

[56] References Cited

U.S. PATENT DOCUMENTS

| | | | |
|---|---|---|---|
| 3,362,160 | 1/1968 | Bourgeois | 415/118 |
| 3,936,217 | 2/1976 | Travaglini et al. | 415/118 |
| 4,300,774 | 11/1981 | Hollis et al. | 277/12 |
| 4,406,580 | 9/1983 | Baran, Jr. | 415/118 |
| 4,470,735 | 9/1984 | Salisbury | 411/353 |
| 4,815,276 | 3/1989 | Hansel et al. | 60/39.33 |

OTHER PUBLICATIONS

Dover AGE19009 *Proprietary* Borescope Plug Proposal Dover Corporation/Cook Airtomic Division By: Luis A. Camacho, Project Engineer, May 16, 1986.

*Primary Examiner*—Richard A. Bertsch
*Assistant Examiner*—Michael I. Kocharov
*Attorney, Agent, or Firm*—Jerome C. Squillaro; David L. Narciso

[57] ABSTRACT

A borescope sealing apparatus and plug includes semi-spherical sealing surfaces on the plug's sealing end and a conical hole sealing seat to receive the sealing end. The invention provides good sealing during engine operation wherein thermal growth causes misalignment of the borescope holes. The borescope plug further includes an axial shaft and a spring loaded end having a spring means which is operable to bias the sealing end into the sealing seat. The spring means suggested are crest to crest wave spring, coiled spring, and a pressurized bellows. The sealing apparatus and borescope plug is particularly useful for sealing borescope holes in double wall casings such as those found in gas turbine engines.

20 Claims, 3 Drawing Sheets

BORESCOPE PLUG

The Government has rights in this invention pursuant to Contract No. F33657-83-C-0281 awarded by the Department of the Air force.

BACKGROUND OF THE INVENTION

Field of the Invention

The present invention relates to hole sealing means for sealing opposing holes in spaced apart walls and, more particularly, to such sealing means for use in sealing borescope holes in gas turbine engines.

Gas turbine engines incorporate structures, such as casings which operate in very hot environments which causes the structures to undergo differential thermal growth. The engines often include spaced apart walls or casings having opposing holes which require removable sealing means. For example, in the aircraft engine industry, many engines include double walled structures, such as compressors and combustors, wherein the outer and inner walls are respectively provided with opposing holes. One purpose of such opposing holes is to allow inspection and monitoring of the engine. This may be accomplished by inserting inspection equipment, such as borescopes and/or probes, through such holes. Examples of such inspection apparatus can be found in U.S. Pat. No. 3,362,160 entitled, "Gas Turbine Engine Inspection Apparatus" issued to Bourgeois on Jan. 9, 1968; in U.S. Pat. No. 4,300,774 entitled, "Removable sealing plug for spaced apart wall structure", issued to Hollis et al. on Nov. 17, 1981; and in U.S. Pat. No. 4,815,276, entitled, "Borescope Plug" issued to Hansel et al. Mar. 28, 1989; all of which are hereby incorporated by reference.

The problem with the prior art is that the single borescope plug sealing apparatus does not accommodate differential thermal growth between the two casings very well. The inner casing, which is subjected to greater temperatures than the outer casing, experiences a different amount of thermal growth so that the spaced apart holes become misaligned during engine operation causing seal leakage. This may allow hot gases to flow into passageways such as a bypass duct which was not designed to contain hot gases which in turn may lead to a loss of structural integrity. Furthermore, the leakage can cause decreased power capability and lower fuel efficiency. Borescope plugs also interfere with gas stream between the two casings and therefore cause aerodynamic problems which further decreases the efficiency of the engine.

Accordingly, it is a general object of this invention to provide a sealing means for double wall structures subject to differential thermal growth.

Another object of the present invention, is to provide such sealing means with a single easily accessible borescope plug.

Yet another object of the present invention, is to provide such sealing means with a minimal amount of interference with the flow between the two walls.

SUMMARY OF THE INVENTION

The invention provides apparatus for removably sealing at least a pair of opposing holes in at least two respective spaced apart walls wherein each of the walls includes a respective opposing hole. A sealing borescope plug is provided having a relatively thin shaft with a first and second sealing means disposed at respective opposite ends of the shaft and designed to extend between the two spaced apart walls. The first sealing means includes a semi-spherical sealing surface. The second end of the shaft includes a fastening and second sealing means for removably fastening the borescope plug in a substantially sealed manner to the opposing hole in one of the walls. In the preferred embodiment the shaft includes a spring means operable to place the borescope plug in compression and maintain the sealing ends and respective holes in a sealing relationship. In the preferred embodiment the spring means is a crest to crest wave spring. In another embodiment the spring means is a coiled spring while in another embodiment it is a bellows and includes a means for pressurizing the bellows such as a duct through the shaft which is operable connected to a source of high pressure fluid relative to the pressure of the fluid around the bellows.

DETAILED DESCRIPTION OF THE INVENTION

Figure 1:
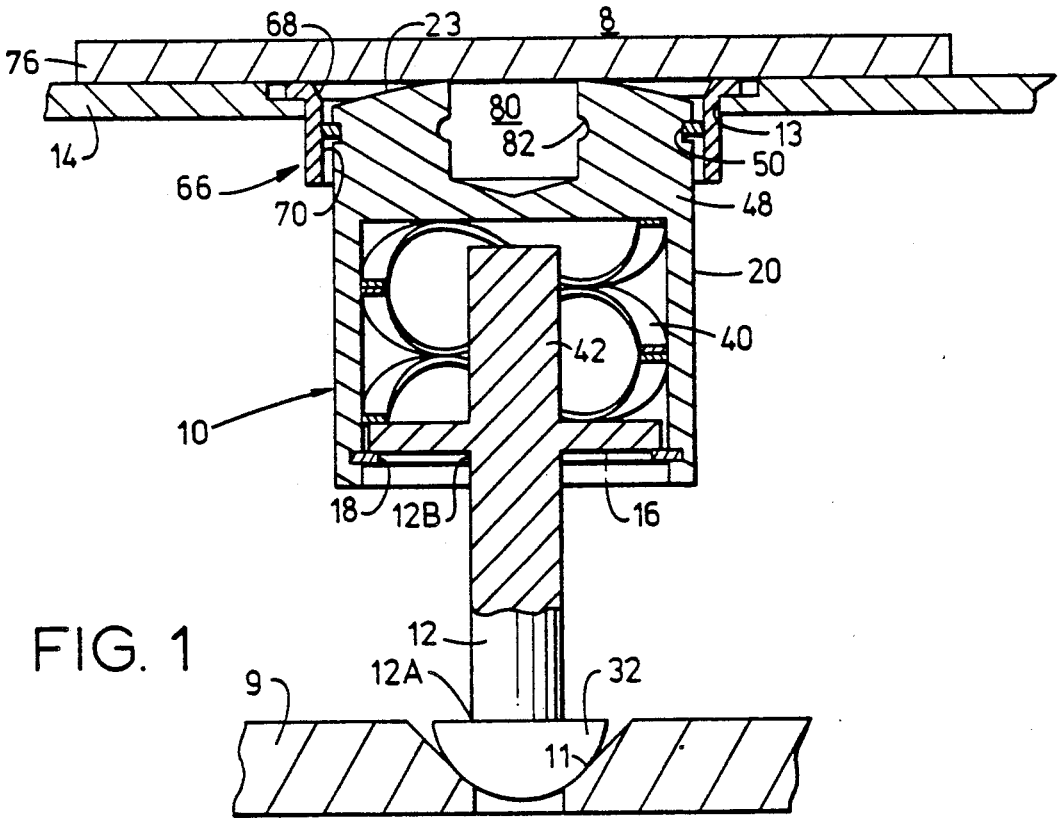
FIG. 1 is a partial cut-away cross sectional view showing the preferred embodiment of the present invention.

Referring initially to FIG. 1, one form of sealing apparatus of the present invention is generally designated 8 and, in the embodiments described herein, represents a borescope plug assembly 8 having a borescope plug 10 which seals at least first and second opposing holes 11 and 13 in respective first and second opposing walls 9 and 14. Typically in gas turbine engines an outer wall or casing such as second wall 14 is an outer compressor or turbine casing or even a fan duct and first wall 9 is an inner compressor or turbine casing. The borescope plug 10 includes a relatively narrow axial shaft 12 having a pair of opposing axial ends 12A and 12B. The first end 12A of the shaft 12 includes a semi-spherical sealing means 32 which in the preferred embodiment is a hemispherical sealing plug 32 and designed to seat within and seal first hole 11, which is conically shaped. Second end 12B has a circular base 16 which is slideably mounted within an annular borescope plug housing 20 and retained within the housing by a snap ring 18. A spring means 40 which, in the preferred embodiment is a crest to crest wave spring, is disposed within the annular borescope plug housing 20 and retained therein by base 16 and snap ring 18. Housing 20 further includes a solid back end 48 which provides a reaction wall for spring means 40 to bias shaft 12 outward toward first hole 11 and help maintain borescope plug 10 in compression and sealing engagement with holes 11 and 13.

A travel limiter 42 extends from the center of base 16 within annular housing 20 towards back end 48 prevents excessive compression of spring means 40 which may lead to failure of the spring means. Travel limiter 42 also helps to provide a borescope plug retention means which is operable to prevent first end 12A from entirely disengaging from first hole 11 in case of a failure of spring means 40. Proper sizing of the depth of first hole 11 and the gap between limiter 42 and back end 48 limits the possible collapse of borescope plug 10 so that it cannot be dislodged from its position between the two opposing walls.

A cover plate 76 is fastened to second wall 14 in a manner so as to help retain borescope plug 10 in place. Insertion means is provided in the outer surface of back end 48 in the form of a square drive hole 80 having four locking dimples 82 operable for interlocking attachment with a common socket wrench drive or extension. This allows easy insertion and removal of borescope plug 10 using tools commonly found in a mechanics tool box and thereby simplifying the removal and assembly of sealing apparatus 8. Back end 48 is shown as having a rounded outer surface 23 which is semi-spherical in shape for the purpose of enhancing the borescope plug's ability to tilt while still maintaining seal integrity. The rounded surface feature is not necessary for the embodiments shown using the crest to crest wave spring 40 of the preferred embodiment nor for the alternate embodiment shown in FIG. 2 where a coiled spring 40 is used as a spring means but it is particularly useful in the embodiment depicted in FIGS. 3 and 4 wherein the spring means is a bellows.

Figure 2:
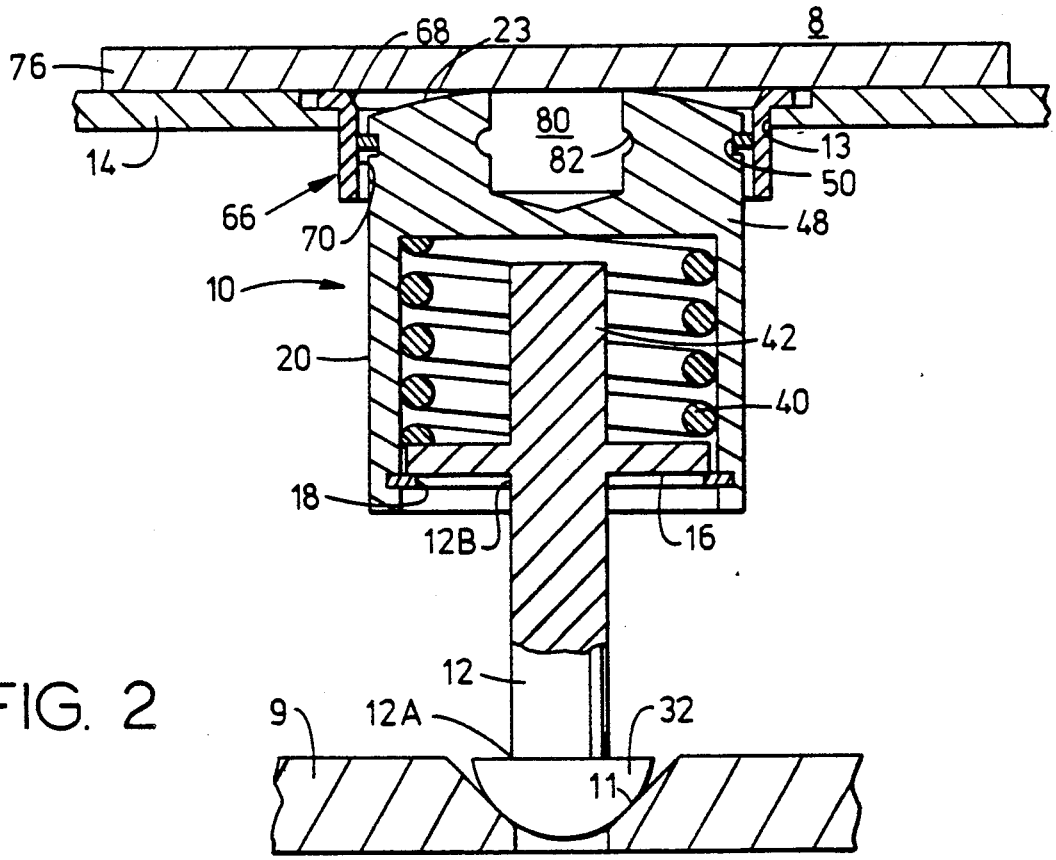
FIG. 2 is a partial cut-away cross sectional view showing one embodiment of the present invention having a spring means in the form of a coiled spring.

An annular groove in the back end 48 of housing 20 has disposed within it a split ring 50 similar in design and function to a piston ring. An annular collar 66 having a chamferred edge 68 at its entrance is disposed within hole 13 and is provided with a bore designed to provide a sealing surface for split ring 50 to sealingly engage. The chamferred edge 68 provides a means to compress split ring 50 which is biased outward in its uncompressed state to have a diameter larger than that of bore 70. Insertion of borescope plug 10 through collar 66 causes the uncompressed split ring 50 to first engage chamferred edge 68 and then be compressed by it so as to fit into bore 70. An alternative embodiment is shown in FIG. 2 wherein spring means 40 is a coiled spring.

Figure 1A:
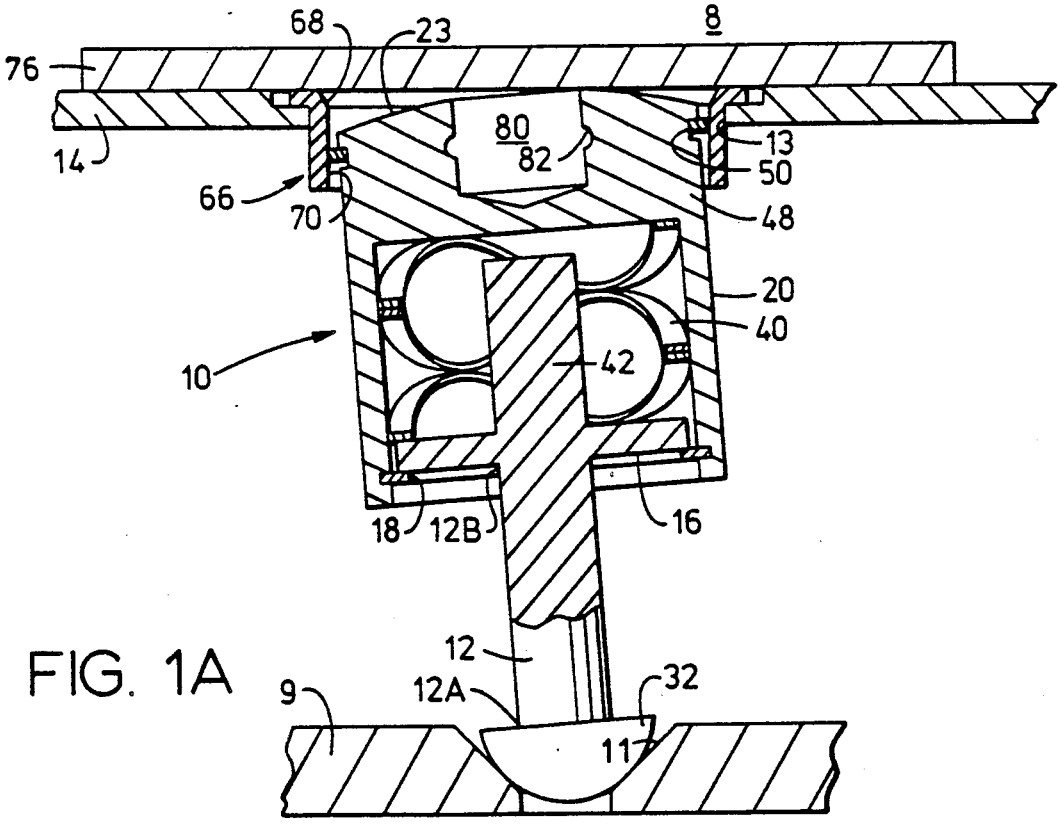
FIG. 1A is a partial cut-away cross sectional view showing the preferred embodiment shown in FIG. 1 wherein the borescope plug of the present invention is shown at an exaggerated angle as it might appear during engine operation.

FIG. 1A shows how borescope plug 10 tilts during engine operation but still maintains seal integrity at first hole 11.

Figure 3:
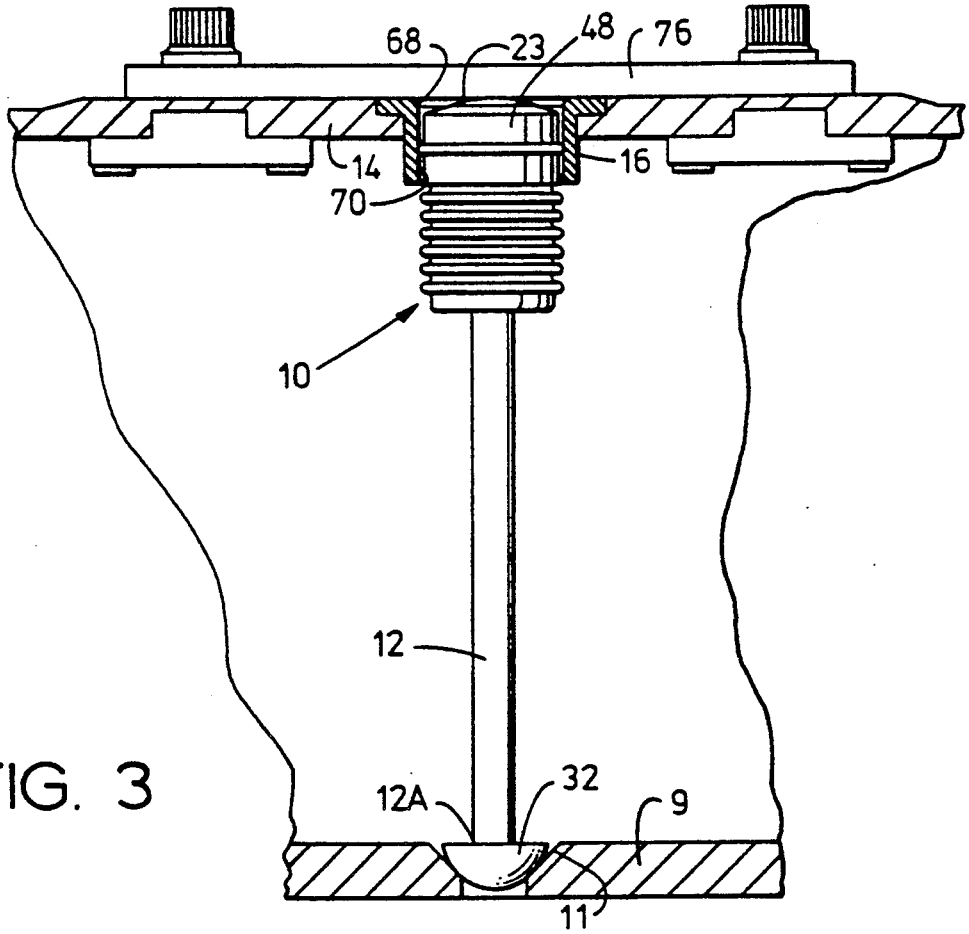
FIG. 3 is a partial cut-away cross sectional view showing another embodiment of the present invention having a bellows for a spring means.
Figure 4:
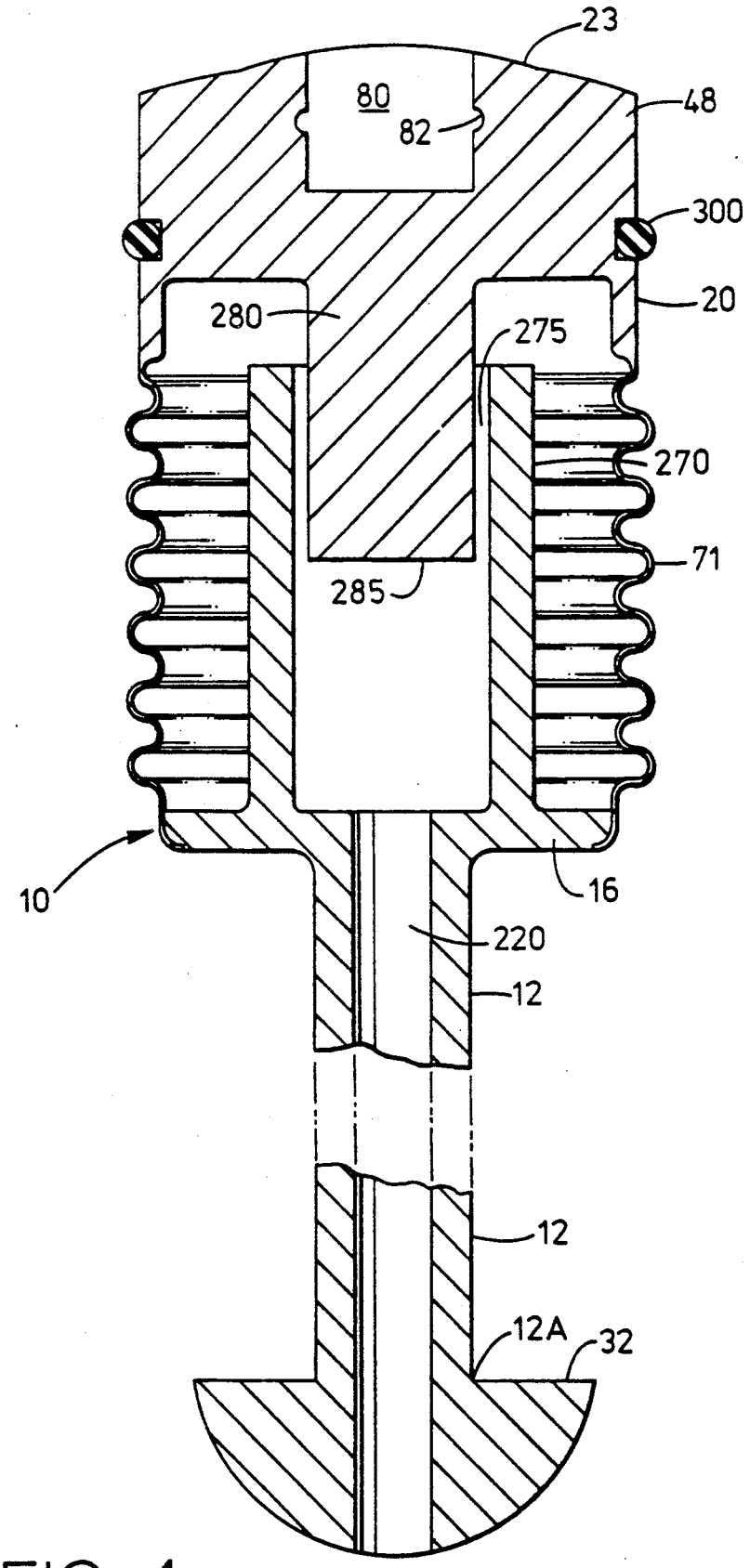
FIG. 4 is a cross sectional and partial cut-away view showing the interior of the borescope plug of the present invention having a bellows for a spring means.

FIG. 3 and FIG. 4 depict an alternative embodiment of the present invention wherein spring means 40 is a bellows 71 disposed, in pressure sealing fashion, between base 16 and back end 48 of annular housing 20. The spring like resiliency of bellows 71 is provided by a pressure difference across first wall 9 which, in a gas turbine engine, may separate relatively low pressure air in the fan or compressor bypass duct between walls 14 and 9 and the higher pressure compressor air on the other side of first wall 9. High pressure air is ducted through a duct 220 to a hollow interior 110 of bellows 71 thereby expanding bellows 71 and causing it to behave like a spring and provide the spring force to place borescope plug 10 in compression. The compressive force maintains the seal at first hole 11.

Referring to FIG. 4 a hollow travel limiter 270 extends from the center of base 16 within the annular housing 20 towards back end 48 prevents excessive compression of bellows 71 which may lead to failure of the spring means. A bellows guide 285 extends from back end 48 into the interior of bellows 71 and is disposed within hollow travel limiter 270 so as to prevent bellows 71 from being overly twisted sideways. Bellows guide 285 is operable to slide within hollow travel limiter 270 but prevented from excessively bending or angling over too much relative to the limiter thereby helping to maintain the pressure sealing integrity of bellows 71 by preventing a rip or tear in the bellows.

Because this embodiment incorporates a spring means which is designed to bend less than its counterpart in the other two embodiments borescope plug and its annular housing tends to tilt more. Therefore, it may be advantageous to use a resilient O ring 300 in the bellows type borescope plug than the split ring of the other two embodiments for improved sealing purposes. The gap between hollow travel limiter 270 and bellows guide 285 should be sufficient to operably pressurize bellows 270 and holes through the limiter may be provided if necessary to allow proper pressurizing of the bellows.

As discussed previously back end 48 is shown as having a rounded outer surface 23 which is semi-spherical in shape for the purpose of enhancing the borescope plug's ability to tilt while still maintaining seal integrity. The rounded surface feature is particularly useful in this embodiment because twisting or bending of the bellows form of the spring means 71 cannot be tolerated as much, for the reasons stated above, as twisting or bending of the spring means in the form of a crest to crest wave spring 40 or coiled spring as depicted in the other two embodiments shown in FIGS. 1 and 2.

Referring to the preferred embodiment shown in FIG. 1, during operation, borescope plug 10 is inserted through second hole 14 with the use of a commonly available socket wrench drive, ¼", ⅜", ½" or other appropriately sized drive or drive extension which is placed into drive hole 80. Insertion causes split ring 50 to ride through the chamferred edge of collar 66 causing ring 50 to compress and engage bore 70 and annular borescope plug housing 20 in a sealing manner to prevent pressurized air from escaping through second hole 13. Cover plate 76 is then fastened in place thereby providing a retaining means to keep borescope plug 10 in compression.

During operation there will typically occur a misalignment of first and second holes 11 and 13 respectively. This will cause the borescope plug 10 to tilt but the semi-spherical shape of sealing plug 32 will continue to seal conically shaped first hole 11 since the spherical portion will be forced to rotate to a different attitude held within the hole by the compressive force exerted by borescope plug 10 in compression. The depth of the conical hole 11 is sufficiently deep so that in case the spring means 40 fails the borescope plug 10 will be held loosely in place between first and second holes and prevented from becoming dislodged and passing through the rest of the engine which could cause excessive foreign object damage commonly referred to as FOD. The relative narrowness of shaft 12 with respect to the wider sealing plug 32 minimizes the aerodynamic losses due to interference with the air flow between first and second walls 9 and 14 respectively.

While the present invention has been described with reference to specific embodiments thereof, it will be obvious to those skilled in the art that various changes and modifications may be made without departing from the invention in its broader aspects. It is contemplated in the appended claims to cover all such variations and modifications of the invention which come within the true spirit and scope of our invention.

What is claimed as new and desired to be secured by Letters Patent of the United States is:

1. A borescope plug for removably sealing a pair of opposing holes in a gas turbine engine structure having spaced apart walls wherein each of the walls includes one of the opposing holes, and further wherein the holes are initially substantially aligned and subject to becoming non-aligned during engine operation, which comprises:

a shaft means for extending between the two spaced apart walls and having a pair of axially opposing ends and a semi-spherical sealing means at first of said ends for sealing the first hole; and an annular borescope plug housing coupled to a second one of said ends adapted to be retained within the second hole; and means for biasing said semi-spherical sealing means into biased sealing engagement with the first hole when the first hole is not aligned with the second hole and for retaining sealing engagement of said first sealing means with said first hole during engine operation.

2. A borescope plug as claimed in claim 1 wherein said semi-spherical sealing means comprises a sealing plug having a semi-spherical sealing surface.

3. A borescope plug as claimed in claim 2 further comprising: a second sealing means coupled to said annular borescope plug housing for sealing the second hole in the second opposing wall, wherein said first and second sealing means are in axial sliding relationship with each other relative to the shaft means axis, and said biasing means comprises a spring means disposed between said first and second sealing means operable to place said first sealing means in compression to compression seal the first hole.

4. A borescope plug as claimed in claim 3 wherein said spring means comprises a crest to crest wave spring.

5. A borescope plug as claimed in claim 3 wherein said spring means comprises a coiled spring.

6. A borescope plug as claimed in claim 3 wherein said spring means comprises a bellows and a duct adapted to pressurize said bellows and said bellows includes a back end having a rounded outer surface.

7. An apparatus for removably sealing first and second opposed holes located in first and second spaced apart walls of a gas turbine engine, respectively, wherein during engine operation the first and second walls grow at different thermal rates, giving rise to misalignment between the first and second holes, said apparatus comprising:

a tiltable shaft means for extending between the two spaced apart walls and having a pair of axially opposing ends;

a semi-spherical first sealing means at a first of said ends for sealing the first hole in the first wall;

an annular borescope plug housing coupled to a second of said ends; and retention means adapted for coupling to the second wall for retaining the plug housing within the second hole;

whereby during engine operation the semi-spherical first sealing means remains sealingly engaged within the first hole as the first and second holes become misaligned.

8. An apparatus as claimed in claim 1 wherein said semi-spherical first sealing means comprises a sealing plug having a semi-spherical sealing surface.

9. An apparatus as claimed in claim 8 further comprising: a second sealing means coupled to said annular borescope plug housing for removably sealing the housing within the second hole in the second wall.

10. An apparatus as claimed in claim 9 further comprising: a spring means coupled to said first sealing means and said plug housing operable to place said first sealing means in compression to further compression seal the first hole.

11. An apparatus as claimed in claim 10 wherein said first hole has a conical seat portion for seating said first sealing means and said first and second sealing means are in axial sliding relationship with each other and said spring means is disposed between said first and second sealing means.

12. An apparatus as claimed in claim 11 wherein said spring means comprises a crest to crest wave spring.

13. An apparatus as claimed in claim 12 further comprising:

said retention means comprising a cover plate for engaging said housing;

said annular borescope plug housing having a rounded outer surface for permitting pivotal movement of said housing relative to said cover plate, whereby said housing can tilt relative to said cover plate for maintaining sealing engagement between said first hole and said first sealing means during engine operation.

14. An apparatus as claimed in claim 11 wherein said spring means comprises a coiled spring.

15. An apparatus as claimed in claim 11 wherein said spring means comprises a bellows and a duct adapted to pressurize said bellows.

16. A borescope sealing apparatus for removably sealing first and second opposed borescope holes in respective first and second spaced apart gas turbine engine walls, said apparatus comprising:

an annular collar disposed in the hole of the second wall, a borescope plug extending between the two spaced apart walls, said plug having a shaft with a pair of axially opposed ends, a semi-spherical sealing means at a first of said ends for sealing the first hole, a second of said ends being coupled to an annular borescope plug housing disposed within said annular collar, a second sealing means coupled to said annular borescope plug housing for sealing the second hole and achieving sealing engagement with at least a portion of said collar; and retention means adapted for coupling to the plug housing and the second wall and for retaining the boroscope plug;

whereby said boroscope plug remains sealingly engaged within the first hole and said annular collar during engine operation despite different thermal growth of said first and second walls.

17. A borescope sealing apparatus as claimed in claim 16 further comprising: a spring means operably coupled to said semi-spherical sealing means to place said semi-spherical sealing means in compression to compression seal the first hole.

18. A borescope sealing apparatus as claimed in claim 17 wherein said first hole has a conical seat portion for seating said first sealing means and further wherein said first and second sealing means are in axial sliding relationship with each other, said spring means disposed between said first and second sealing means.

19. A borescope sealing apparatus as claimed in claim 18 wherein aid annular housing includes a first solid back end and a second open end having a circular base and wherein said spring means comprises a crest to crest wave spring disposed within said annular housing and wherein said shaft means is coupled at its second axial end to said base to be biased outward from said annular housing by said spring means.

20. A borescope sealing apparatus as claimed in claim 19 wherein said second sealing means comprises a split ring biased outward of and disposed within an annular groove in said annular housing.

* * * * *